United States Patent [19]

Benoit

[11] 4,220,214

[45] Sep. 2, 1980

[54] DIRECTIONAL DRILLING SUB

[76] Inventor: Lloyd F. Benoit, Rte. 1, P.O. Box 57B, Arnaudville, La. 70512

[21] Appl. No.: 825,589

[22] Filed: Aug. 18, 1977

[51] Int. Cl.[3] ..... E21B 7/08; E21B 7/04

[52] U.S. Cl. ..... 175/61; 175/74

[58] Field of Search ..... 175/61, 73, 74, 75, 175/256; 285/184, 282, 164; 64/8

[56] References Cited

U.S. PATENT DOCUMENTS

| | | | |
|---|---|---|---|
| 2,336,333 | 12/1943 | Zublin | 175/75 X |
| 2,680,005 | 6/1954 | Storm | 175/256 |
| 3,190,374 | 6/1965 | Caperan et al. | 175/256 X |
| 3,586,116 | 6/1971 | Tiraspolsky et al. | 175/256 X |
| 3,667,556 | 6/1972 | Henderson | 175/73 |
| 3,679,236 | 7/1972 | Warshawsky | 285/282 X |
| 3,713,500 | 1/1973 | Russell | 175/73 |
| 4,067,404 | 1/1978 | Crase | 285/184 |
| 4,077,657 | 3/1978 | Trzeciak | 175/61 X |

*Primary Examiner*—James A. Leppink
*Assistant Examiner*—Richard E. Favreau

[57] ABSTRACT

A directional drilling "sub" provides a shifting end portion which allows the sub to be rotated from a first in-line axially straight orientation with the drill string to a second angled or "bent" position which second position is normally associated with conventional bent "subs" which are permanently structured in the bent position. The device shifts from the first (in-line) position to the second (bent) position upon the application of torsional force thereto which torsional force can be applied, for example, by the actuation of a "turbodrill" (normally attached thereto in operation). The device can be manufactured or machined to provide varying angles to the sub in its bent position to satisfy differing directional drilling situations. The axially aligned first position allows easy entry of the drill string, sub, and turbodrill into the well hole, while the second bend position is used to commence directional drilling. The sub will return gradually to its original axially aligned position when the device is withdrawn from the wellhole, as such position is the path of minimum resistance for the withdrawing drill string and torsion is not present to hold the sub in the bent position.

17 Claims, 11 Drawing Figures

DIRECTIONAL DRILLING SUB

BACKGROUND OF THE INVENTION

1. Field of the Invention

The present invention relates to oil well drilling and more particularly relates to directional drilling. Even more particularly the present invention relates to the use of "subs" in combination with a conventional turbodrill wherein in the invention the "sub" movably shifts from a first position in which the turbodrill is substantially axially aligned with the drill string, to a second or "bent" position whereby a deflection is created between the drill string and the turbodrill of a desired degree.

2. General Background and Prior Art

Although wellbores are normally planned to be drilled vertically, many occasions arise when it is necessary or advantageous to drill at an angle from the vertical. Controlled directional drilling as it is referred to in the art makes it possible to reach sub-surface points laterally remote from the point where the drill bit enters the earth. Some examples of the use of directional drilling are inaccessible locations (such as under rivers or like bodies of water when the drilling begins on land), salt dome control, relief well control, edgewell control, fault plane control and property line control. Additionally, directional drilling is employed in offshore applications where all the drilling necessarily must take place from a fixed platform in a location in the offshore waters. A further application of directional drilling is seen when obstructions prevent a substantially vertical well direction.

One method of directionally drilling wells is a whipstock method. Another method is a very popular method which employs the use of a turbodrill in combination with a bent sub assembly (see FIG. 1). The turbodrill is a conventional device which uses fluid that is pumped under pressure through the center of the motor directed downwardly through void areas between a "rotor" and a rubber-lined spiral passageway of an outer "stator." In order for the flow to occur, the rotor is displaced and turned within the stator by the pressure of the fluid column, thus powering the connecting rod, a hollow drive shaft and finally a conventional bit subs at the end of the tool.

One such manufactured turbodrill is the "Dyna-Drill" which was introduced in or about 1964. Operation and use of the "Dyna-Drill" for directional drilling can be found in "Dyna-Drill Handbook" (second edition) distributed by Dyna-Drill, Division of Smith International, Inc., P.O. Box 327, Long Beach, Calif. 90801.

In drilling, a "sub" is a short threaded piece of drill pipe used to adapt generally parts of the drilling string which cannot otherwise be screwed together because of difference in thread size or design. In the case of directional drilling, the "sub" is bent to produce the desired angle between the lower portion of the drill string (a non-magnetic survey collar normally being the lowermost portion of the drill string which attaches to the sub) and the turbodrill, "Dyna-Drill," or the like which attaches to the opposite end of the sub (this general arrangement is illustrated in FIG. 1 of the drawings wherein a conventional permanently bent sub of the prior art is illustrated).

The use of a fixed or non-shifting bent sub requires that the drill string must be lowered into the well from the surface with the bent sub creating a kink in the lowermost portion of the drill string which kink causes problems in lowering the turbodrill into the well. Since the turbodrill is of some length (a length of thirty feet [30'] being exemplary), even a small degree of bending in the sub can create a relatively large eccentricity in the drill string.

Many patents have been issued which are directed to the problem of directional drilling. Most of these patents provide structures which are directed to solving the problem of effecting the directional drilling itself, but do not solve the problem of lowering the turbodrill and bent sub in the "kinked" position into the well.

A listing of some prior art patents which may be pertinent are listed in the following table.

| Prior Art Patents | | |
|---|---|---|
| U.S. Pat. No. | Inventor(s) | Issue Date |
| 2,018,007 | W. G. Brewster | Oct. 22, 1935 |
| 2,142,858 | T. E. McMahan | Jan. 3, 1939 |
| 2,197,019 | D. B. Monroe | Apr. 16, 1940 |
| 2,680,005 | L. W. Storm | June 1, 1954 |
| 3,586,116 | W. Tiraspolsky et al | June 22, 1971 |
| 3,679,236 | J. Warshawsky | July 25, 1972 |
| 3,961,674 | J. T. Craig, Jr. et al | June 8, 1976 |
| 4,015,673 | J. T. Craig, Jr. et al | Apr. 5, 1977 |

3. General Discussion of the Present Invention

The present invention in its preferred embodiment provides a directional drilling sub which shifts upon actuation of the attached turbodrill effecting a change in orientation of the sub from a first position in which the drill string and the turbodrill are axially aligned (see FIG. 2) to a second position in which the drill string and turbodrill are deflected with respect to one another (see FIG. 4), forming the desired angle for directional drilling.

The apparatus of the present invention is comprised generally of a barrel having an attachment at one end portion thereof which attachment provides for example a threaded connection which can attach to a conventional drill string, or to a non-magnetic survey or "Monel" collar or the like. The inner portion of the barrel is provided with a sliding sleeve, the sleeve having connected to its outermost end portion a threaded or like connection member for attachment to the turbodrill. This connection member (to which a turbodrill is attachable) and the sleeve to which it is attached are movable with respect to the barrel both slideably and rotatably. This movable connection member thus can be extended and retracted with respect to the barrel or rotated with respect thereto.

The movable connection member nearest the turbodrill is also provided with locking lugs which cooperate with corresponding recesses on the barrel. When the movable connection member slides with the attached sleeve to an extended position, rotation is free through the desired arcuate path effecting the "shift" from a first "aligned" position to a second "bent" position. In such an extended posture, the lugs clear the corresponding recesses of the barrel. Likewise when the sliding sleeve allows the movable connection member to retract into the barrel, the lugs form a fixed non-rotating locking connection with the barrel (see FIG. 4).

Rotation of the movable connection member (to which the turbodrill is connected) effects a change in axial orientation of the rotating connector and its attached turbodrill with respect to the drill string. Thus, a rotation through an arcuate path shifts the turbodrill from an axially aligned position with the drill string to a non-axially or deflected position with the drill string which second or "bent" position is desirable for controlled directional drilling.

BRIEF DESCRIPTION OF THE DRAWINGS

For a further understanding of the nature and objects of the present invention, reference should be had to the following detailed description, taken in conjunction with the accompanying with the accompanying drawings, in which like parts are given like reference numerals and wherein.

DETAILED DESCRIPTION OF THE PREFERRED EMBODIMENT

Structure

Figure 2:
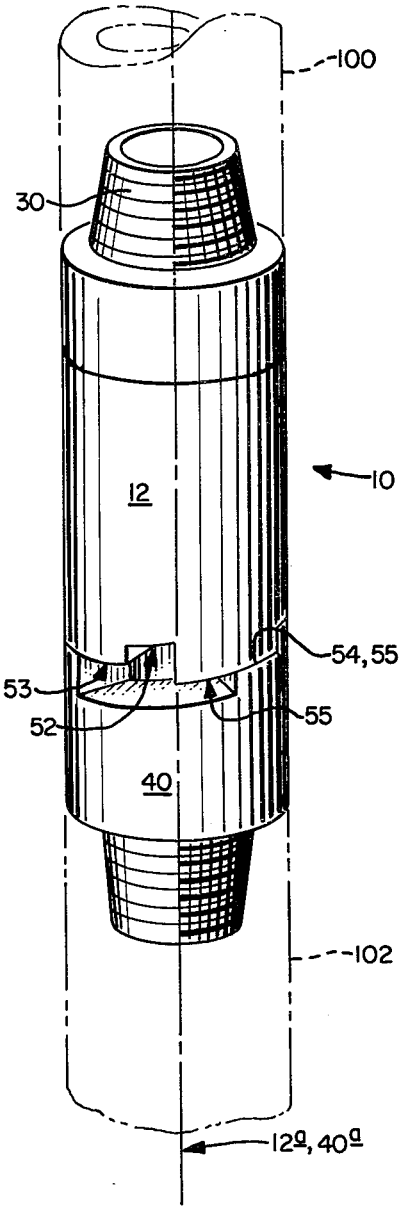
FIG. 2 is a perspective view of the preferred embodiment of the apparatus of the present invention in its axially aligned position.
Figure 4:
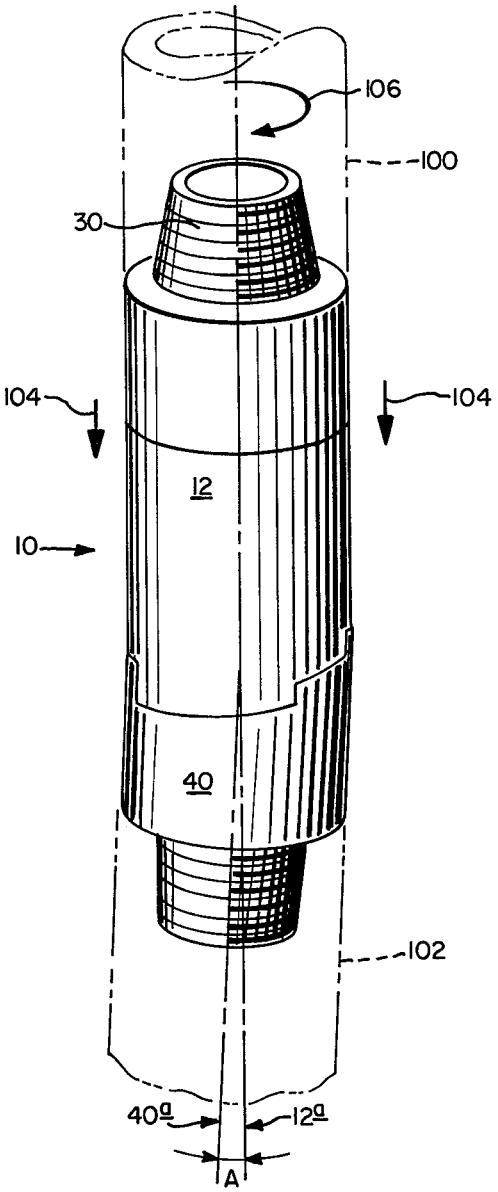
FIG. 4 is a perspective view of the preferred embodiment of the apparatus of the present invention in its "bent" position as desired for directional drilling.
Figure 3:
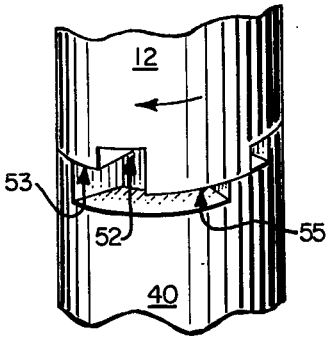
FIG. 3 is a perspective view of the preferred embodiment of the apparatus of the present invention in an intermediate "shifting" position between its axially aligned and deflected positions.

The preferred embodiment of the apparatus of the present invention is designated generally by the numeral 10 in FIGS. 2, 3 and 4. The device is comprised generally of an outer barrel 12, forming a tool body, having an uppermost fixed end connection 30 and a lowermost movable connection 40. As can best be seen by an examination of FIGS. 2, 3 and 4, rotation of movable connection 40 shifts connection 40 from a first axially aligned position (see FIG. 2) to a second non-axially or "bent" position (see FIG. 4).

Figure 1:
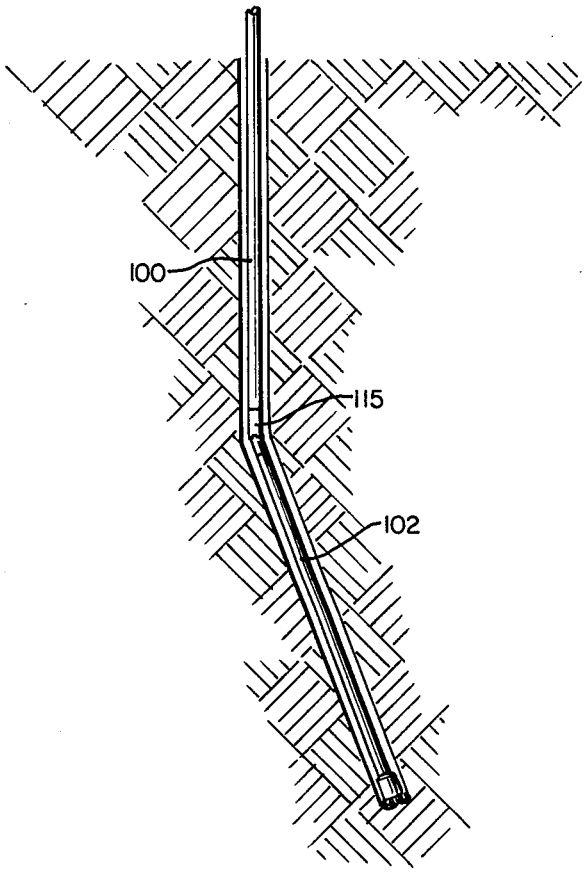
FIG. 1 is a schematic view of a typical turbodrill used in combination with a conventional prior art permanently bent deflecting sub.

FIG. 1 illustrates operation of a conventional sub 115 which is normally permanently fixed in the "bent" or non-axially aligned position shown. Such a conventional sub is usually manufactured by welding pieces of pipe together to form the desired angular configuration. In the method of the present invention, the sub 10 of the present invention would replace the conventional "bent" sub 115 of FIG. 1. Thus, the shifting sub 10 of the present invention could be attached for directional drilling purposes to the lower end of a drill string which is normally a non-metallic survey collar 100, with a turbodrill 102 being attached to the lower part of sub 10. This drilling arrangement is seen with the prior art sub 115 in FIG. 1.

Aside from the rotation and its change in orientation of connection 40, a sliding movement is likewise seen in the apparatus 10 of the present invention, which sliding movement is relative between movable connection 40 and barrel 12. This sliding connection permits rotation to take place when movable connection 40 is moved to an extended position away from barrel 12 as is seen in FIG. 2. When the movable connection 40 is moved towards barrel 12 (and lugs 50 align with recesses 52), the device assumes a non-shifting, non-rotating locked configuration as is seen in FIG. 4. In this position, it can be seen that the device forms a "bent" orientation as is seen in conventional permanently bent deflecting subs which is their permanent structural configuration (see FIG. 1). Note in FIG. 2 that the central longitudinal axis 12*a* of barrel 12 and the central axis 40*a* of movable connection 40 are substantially aligned, while in FIG. 4 the axes (12*a*, 40*a*) of barrel 12 and movable connection 40 respectively are angled with respect to one another, the angle deflection being represented by the letter "A" in FIG. 4.

The orientation seen in FIG. 2 which provides a substantially in-line orientation to sub 10 is used normally to lower the drill string and the attached appropriate directional drilling tools into the hole. When the device has the orientation as shown in FIG. 2, uppermost fixed connection 30 will be connected to a non-magnetic survey collar 100 (frequently referred to as a Monel Collar). The lowermost or rotating end connection 40 is attached to a turbodrill 102, "Dyna-Drill," or the like (see this configuration as illustrated with a conventional permanently bent sub in FIG. 1). Collar 100 and turbodrill 102 are partially shown in phantom lines in FIGS. 2, 3 and 4.

FIG. 4 illustrates the orientation of sub 10 of the present invention, after the "Dyna-Drill" has been actuated which actuation produces a torsion in the drill string which causes sub 10 to shift, with movable connection 40 rotating, and its rotation effecting the eccentricity in the drill string as aforementioned. When the "Dyna-Drill" is thereafter lowered and begins drilling, the movable connection 40 will collapse, with lugs 50 interlocking with recesses 52 to form a substantially tight non-shifting bent sub 10 (as has occurred in FIG. 4). It should be understood that the torsion (illustrated by curved arrow 106) produced in the drill string by the rotation of the turbodrill, "Dyna-Drill", or the like, will always urge the sub 10 into the "bent" configuration shown in FIG. 4. Likewise, as long as axial force (note arrows 104 in FIG. 4) is present in the drill string (as is normally the case), the movable connection 40 will always be in a collapsed position with respect to sub 10, with lugs 50 locking into recesses 52.

Figure 5:
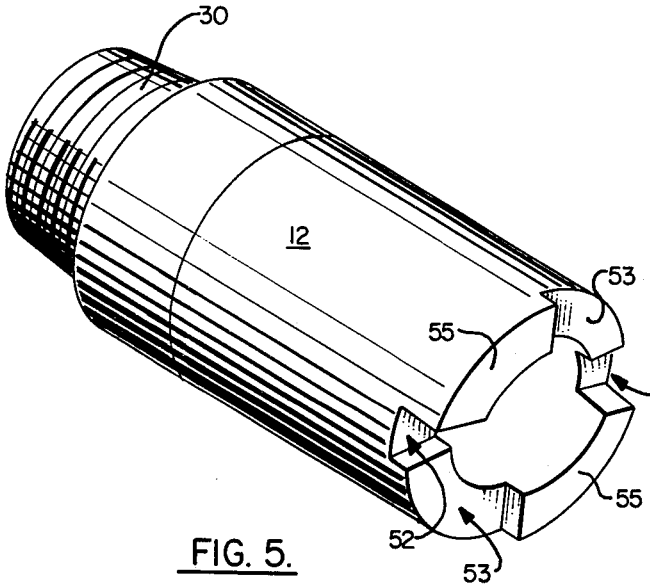
FIG. 5 is a perspective view of the barrel portion of the preferred embodiment of the apparatus of the present invention.
Figure 6:
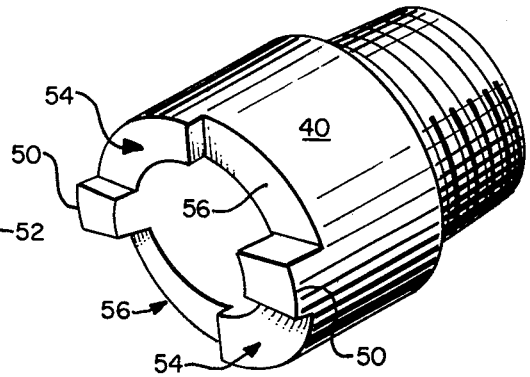
FIG. 6 is a perspective view of the movable end connection portion of the apparatus of the present invention.

FIGS. 5 and 6 illustrate best the locking lug arrangement of the apparatus of the present invention. While the first, intermediate and last positions of the sub 10 can be best seen in FIGS. 2–4 as the device shifts from an in-line position to a bent position, the actual lug configuration can be better seen in FIGS. 5 and 6. An inspection of FIGS. 5 and 6 will reveal that a plurality of surfaces are provided on barrel 12 and on movable connector 40. An inspection will also reveal that projections on connection 40 have corresponding recesses in barrel 12. As aforementioned, lugs 50 of movable connection 40 have corresponding recesses 52 on barrel 12. It will be noted that both barrel 12 and movable end connection 40 are provided with sliding surfaces which abut and frictionally slide against one another when the device is in an intermediate stage (note FIG. 3) where it is shifting from its aligned position to its bent position as shown in FIGS. 2 and 4 respectively. These sliding surfaces and their positions with respect to lugs 50 and recesses 52 are best seen in FIGS. 5 and 6. Barrel 12 is provided with two sliding surfaces 53 which rest against the slide with respect to sliding surfaces 54 of movable and connection 40. There is additionally provided on barrel 12 a pair of lugs 55 which correspond to recesses 56 on movable connection 40. Upon assembly in a bent position of sub 10, lugs 55 interlock and fit within recesses 56 as can best be seen in FIG. 4.

An inspection of FIGS. 5 and 6 will reveal that the surface of lugs 55, the surface of sliding surface 53, and the innermost portion of recess 52 are at three different elevations with respect to one another. Likewise, the lowermost surface of recess 56, the surface of sliding surface 54, and the uppermost portion of lugs 50 are at three different respective elevations on movable connection 40. This is an important feature, because it provides an intermediate position as can best be seen in FIG. 3 where the device can freely rotate through only a certain arcuate distance in order to shift from an axially aligned to a bent position. As is best seen in FIG. 2, the surface of lugs 55 of barrel 12 slides upon and rests on the "intermediate" elevational surface of movable connection 40, that surface being sliding surface 54. This sliding can only occur through an arcuate distance of a desired degree (that degree of rotation being an element of design) since lugs 55 will abut against lugs 50 at each end of the arcuate path of rotation. In the preferred embodiment shown in FIGS. 2–6, the sub 10 is designed to rotate through an angle of approximately 60 degrees (this being merely an exemplary arcuate travel distance).

When the sub rotates to its fully deflected position as shown in FIG. 4, lugs 55 interlock into recess 56, and lugs 50 of movable connection 40 interlock into recesses 52 of barrel 12.

Figure 9:
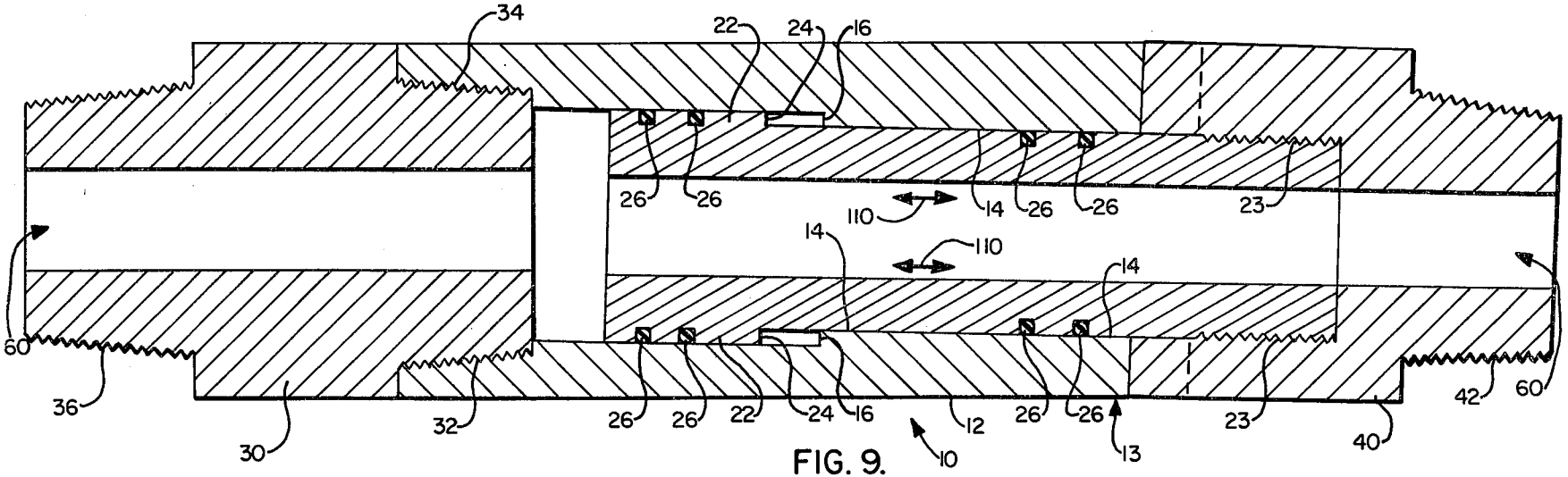
FIG. 9 is a sectional view of the preferred embodiment of the apparatus of the present invention in its "bent" position as desired for directional drilling.
Figure 11:
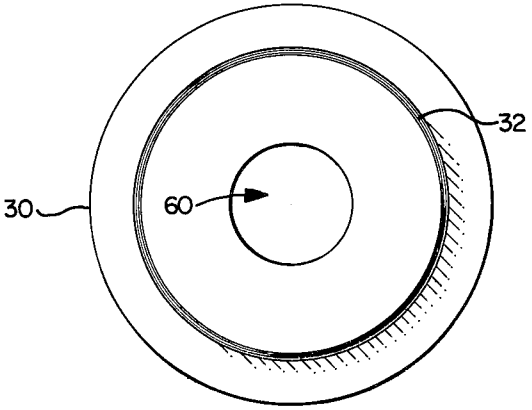
FIG. 11 is an end view of an end connector of FIG. 10.

FIG. 9 provides a sectional view of the preferred embodiment of sub 10 of the present invention. As can best be seen by FIG. 3, a central aperture 60 is provided through the centermost portion of sub 10, aperture 60 providing an opening through which drilling mud or like fluid can be pumped in order to operate the turbodrill, "Dyna-Drill," or like directional drilling apparatus.

The sub 10 is shown in its non-axial or bent configuration in FIG. 9. Barrel 12 houses an inner sliding sleeve 20 which slidably fits within barrel 12 and abuts the inner wall 14 thereof. The sliding mount of sleeve 20 within barrel 12 is illustrated by arrows 110 in FIG. 9.

The innermost end portion of sleeve 20 provides an enlarged annular section 22 with a shoulder 24 being provided between the enlarged section 22 and the remaining portion of sleeve 20. A cooperating change in diameter is seen at this point in barrel 12 which provides a stop 16 for limiting the sliding movement of sleeve 20 within barrel 12. Normally, sleeve 20 could be removed from barrel 10 by sliding movement away from stop 16. However, in assembly, fixed connection 30 is threadably affixed to sleeve 14, and thereafter prevents the removal of sleeve 14 from barrel 12. The sliding movement of sleeve 14 and its attached rotating connection 30 is fixed in both directions. Sliding motion to an "extended" position is stopped when shoulder 24 hits stop 16. Sliding motion to an "innermost" or "recessed" position is stopped when movable connection 40 abut barrel 12.

The assembly of sub 10 is completed when fixed end connection 30 is attached to the end portion of barrel 12 opposite movable connection 40. In the preferred embodiment shown in FIG. 4, this connection is a threaded connection 32.

Fixed end connection 30 is preferably of a substantially identical external diameter to that of barrel 12. The end portion of fixed connection 30 (which is free and normally connectable to the drill string or non-magnetic survey collar 100 as the case may be) is preferably provided with threads 36 which would be conventional and easily allow attachment to such conventional drill string or non-magnetic survey collar 100.

Figure 10:
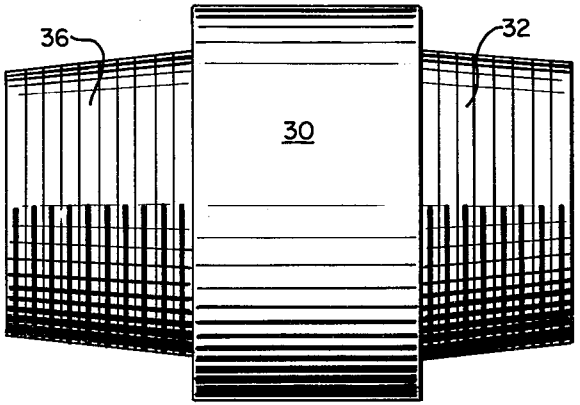
FIG. 10 is a side elevation of an end connection of the apparatus of the present invention.

FIG. 10 illustrates fixed end connection 30, showing its threaded connection 32 which attaches to barrel 12, and its conventional drill string type thread 36 (or like desirable connection) which attaches to the drill string, Monel Collar, non-magnetic survey collar 100 or the like.

The preferred embodiment of sub 10 of the present invention, is shown in FIG. 9 in its shifted, bent condition. As can best be seen, this bent orientation is effected by a rotation of movable connection 40 with respect to barrel 12 (note also FIGS. 2–4). The eccentricity is produced by the rotation, since the inner wall 14 of barrel 12 is angled with respect to the outer surface 13 thereof. Likewise, movable connection 40 is threadably mounted on sleeve 20 with a desired angular orientation between their central axes. With such a structure, the device rotates to a position which aligns the central axis 40*a* of movable connecton 40 with the axis of fixed end connection 30 and the axis 12*a* of barrel 12 as is desirable while lowering sub 10 and its attached turbodrill and drill string into the hole. A rotation through the appropriate designed arcuate path produces an eccentricity between the axes of movable connection 40 and barrel 12 (as discussed more fully above; note FIGS. 2–4).

The change in degrees or the bent deflection is a matter of choice after one skilled in the art applies the teachings of the present invention. Thus, sub 10 could be easily machined to provide a one degree (1°), one-and-one-half degree (1½°), two degree (2°), two-and-one-half degree (2½°), three degree (3°) or like bent sub connection these being typical sub degree deflections in the art. The selection of the angle of the sub is normally predetermined by the amount of angle and/or direction change required to maintain a proposed course for a given drilling situation. Normally a designed would take several factors into consideration in selecting the proper angle for sub 10. Some factors which would be considered would be:

1. Hole size;
2. Directional control required;
3. Angle change per foot of hole drilled; and
4. The amount of drilling that can be accomplished with given bits for a given turbodrill.

Figure 7:
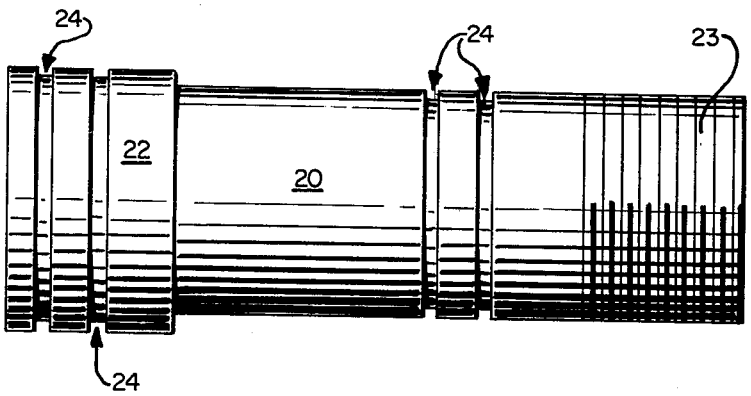
FIG. 7 is a front view of the sliding sleeve portion of the apparatus of the present invention.
Figure 8:
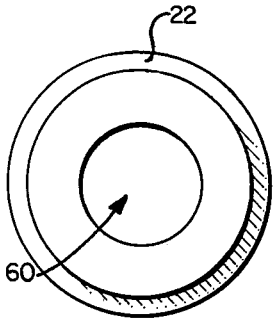
FIG. 8 is an end view of the sliding sleeve portion of the apparatus of the present invention shown in FIG. 7.

FIGS. 7 and 8 illustrate the sleeve 20 portion of the sub 10 of the present invention. Sleeve 20 can be provided with any conventional thread 23 for attachment to movable connection 40. The connection can be made permanent by welding or the like after assembly if desirable.

The opposite end portion of sleeve 20 from threads 23 provides an enlarged annular section 22 as aforementioned. Sleeve 20 can be provided with a plurality of grooves 24 to which can be attached O-rings 26. This would prevent seepage or leaking of drill mud from inner bore 60.

OPERATION

An operation of the apparatus 10 of the present invention can best be seen by an inspection of FIGS. 2–4. In FIG. 2, the device is shown in its axially aligned position. In this position, movable connection 40 is in an extended position, with sleeve 20 moving until shoulder 24 abuts and stops against stop 16. In this position, lugs 50 project beyond the end surface 13 of barrel 12, thus clearing lugs 50 from rotation stops 15.

After drilling operations are completed, the drill string can be withdrawn from the well hole. Upon withdrawal, the sub 10 will extend with sleeve 20 sliding and movable head 22 extending to an extended most position whereby its ability to rotate with respect to barrel 12 is restored. Since the turbodrill or like drilling tool is no longer actuated, torsion is absent from both the drill string and sub 10. Thus the urging force necessary to hold the sub 10 in a bent position is absent and the sub 10 (with connection 40 now free to rotate with respect to barrel 12) will gradually re-assume an aligned position as the drill string is withdrawn from the well hole. The axially aligned position is gradually reassumed since it is the path of least resistance, and no force is present to hold the sub 10 in the "bent" position.

In the method of the preferred embodiment of the present invention, the sub 10 is connected to the lowermost poriton of the drill string. An appropriate drilling means 102 such as a turbodrill, "Dyna-Drill" or the like is attached to the sub 10 at movable connection 40. The axes of barrel 12 and movable connection 40 are then aligned axially so that the entire axially aligned drilling apparatus can be lowered into the well hole. When the drill 102 reaches the desired position in the well hole and the turbodrill or like drilling means are positioned as desired, the drilling means is actuated to produce a torsion in the sub to effect a shifting of the sub 10 to a second axially deviated position. Such a deviated position in the sub 10 produces a corresponding deviating angle "A" (see FIG. 4) between the axes of the drill string and the drilling means. Thereafter, directional drilling can be commenced as is desirable.

The entire device can be removed easily after drilling is completed. The drilling means is shut off, ending torsion to the drill string and sub 10. The sub then extends when withdrawal of the string is commenced, then sub 10 is free to rotate and does so gradually rotate to the axially aligned position, that path being the path of least resistance as te drill string is withdrawn.

In the preferred embodiment as described herein has contemplated the use of a turbodrill, "Dyna-Drill" or like directional drilling tool which produces torsion in sub 10 upon its rotary actuation. It should be understood however that other drilling tools could be used in combination with the present invention if they create a torsion in the sub 10 which torsion produces a shift in sub 10 from an "axially aligned" position to a bent position. Likewise, the present invention could be adapted wherein the barrel and movable connection can be moved relative to each other for angular deviation by direct mechanical means or other means actuated for example from the surface or otherwise.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A method of directional drilling using a rotatable drilling means and drill string comprising the steps of:

(a) providing a directional drilling sub, which sub comprises:
  (i) a tool body;
  (ii) first connection means on said tool body for attaching said tool body to a drill string;
  (iii) second connection means on said tool body for attaching a rotating drilling means to said tool body; and
  (iv) shifting means associated with said tool body for forming an angular deviation between said first and said second connection means, said deviation producing a deviating angle between a drill string attached to said tool body and a rotating drilling means attached to said tool body;
(b) attaching the sub to the drill string at said first connection means;
(c) attaching the drilling means to the sub at said second connection means;
(d) providing the sub in a first position which substantially aligns the central axes of the drill string and drilling means;
(e) lowering the axially aligned drill string and drilling means with the attached sub into a well hole;
(f) actuating the rotatable drilling means to produce a torsion in the sub to effect a shifting of the sub to a second, angularly deviated position which produces a deviating angle between the axes of the drill string and the drilling means; and
(g) directionally drilling with the drilling means.

2. The method of claim 1 wherein the first and second connection means can move axially away from each other with respect to one another when the drill string is pulled upward and then can rotate with respect to one another and wherein, after the desired directional drilling is completed, there is included the further step of removing the drill string and attached sub and drilling means from the well hole, the sub gradually assuming the axially aligned first position when the drill string is removed from the well hole by means of the upward movement of the drill string and sub causing the realignment to take place.

3. The method of claim 1 wherein in step "a" there is included the further step of mounting the second connection means on said tool body so that it can always rotate in at least one direction with respect to one another during use in the hole when said second connection means and said tool body are in the same relative longitudinal positions they occupy when said central axes are aligned; and wherein in step "f" there is included the further step of using said torsion to rotate said second connecton means with respect to said tool body to produce the deviation.

4. The method of claim 3 wherein in step "a" there is included the further steps of mounting the second connection means on said tool body so that the mounting structure always allows relative longitudinal movement in at least one direction with respect to one another during use in the hole and of providing locking interdigitating means between said second connection means and said tool body for locking them together to prevent any further rotation past the deviation position; and wherein in association with steps "f" and "g" there is included the further step of forcing said second connection and said tool body together by external force to engage said locking interdigitating means.

5. A directional drilling sub, comprising:

(a) a tool body;

(b) first connection means on said tool body for attaching said tool body to a drill string;

(c) second connection means on said tool body for attaching drilling means to said tool body; and (d) shifting means associated with said tool body for forming an angular deviation between said first and said second connection means, the angular deviation producing a diverging angle between a drill string attached to said tool body at said first connection means and drilling means attached to said tool body at said second connection means wherein the drilling means rotates creating torsion at said second connection means and said shifting means is actuated by the rotation of the drilling means.

6. The apparatus of claim 5, wherein said drilling means is a turbo-drill and said shifting is actuated by operating said turbo-drill when said tool body is attached for operation to the drill string and to the turbo-drill.

7. The apparatus of claim 5 wherein rotational movement of said second connection means with respect to said tool body shifts the sub into a deviated configuration when a rotating drilling means attached to said second connection means is actuated, and wherein there is further provided locking means comprised of a plurality of cooperating lugs and recesses on said tool body and on said second connection means, and wherein said lugs fit into and lock with said recesses when said sub is in a retracted position, said lugs and recesses clearing and allowing said tool body and said movable connection to at least partially rotate with respect to one another through an arcuate distance when said movable connection is in an extended position with respect to said tool body.

8. The apparatus of claim 5, wherein said tool body has a first aligned position wherein the central axes of said first connection means and said second connection means are substantially coincident, and, when said tool body is placed in said first aligned position, the central axes of a drill string and drilling means attached to said tool body are likewise substantially coincident.

9. The apparatus of claim 5, wherein there is further provided locking means associated with said tool body for locking said tool body and said second connection means in the deviated position.

10. The apparatus of claim 5, wherein rotation of said second connection means with respect to said tool body shifts the sub into a deviated configuration when a rotating drilling means attached to said second connection means is actuated for drilling.

11. The apparatus of claim 5, wherein said second connection means is movably mounted on said tool body, and movement of said second connection means on said tool body shifts the axis of said second connection means from a position aligned with the axis of said first connection means to a second deviated position, with the axis of said first connection means angled with respect to the axis of said second connection means.

12. The apparatus of claim 11, wherein said second connection means is rotatably mounted on said tool body, and rotation of said second connection means with respect to said tool body effects a shifting from said first position to said second position.

13. A directional drilling sub, comprising:

(a) a tool body;

(b) first connection means on said tool body for attaching said tool body to a drill string;

(c) second connection means rotatably and slidably mounted on said tool body in slidable facial engagement with said tool body for attaching drilling means to said tool body; and (d) shifting means associated with said tool body for forming an angular deviation between said first and said second connection means, wherein an extension of said second connection means away from said tool body to an extended position allows it to freely rotate from a first position aligned with the axis of said first connection means to a second, deviated position, with the axis of said first connection means angled with respect to the axis of said second connection means, a retraction of said second connection means into proximity with said tool body being capable of producing a locking of said second connection means with said tool body, the rotation of said second connection means relative to said tool body thereby being impaired.

14. The apparatus of claim 13 wherein the sliding facial engagements between said second connection means and said tool body are all free of any spiral, threaded engagements and all allow for relative longitudinal movement with respect to each other in at least one direction at all times when located down in the drill hole.

15. A direction tool sub, comprising:

(a) an at least generally cylindrical tool body having:

(1) a central bore open at both ends of said tool body and oriented at a first, predetermined angle from the center longitudinal axis of said tool body, and (2) first locking means on one end;

(b) first, at least generally cylindrical connector means for attaching said tool body to one element of a drill string and a work means combination, said first connector means having:

(1) second locking means at one end which in association with said first locking means allows said first connector means and said tool body to rotate between a first locked position and a second locked position through a predetermined arcuate distance, (2) a shaft, rigidly attached to and extending from the same end of said first connector means as said second locking means at a second predetermined angle from the center longitudinal axis of said first connector means, said second predetermined angle being approximately the same as said first predetermined angle, said shaft rotatable fitting in said tool body bore, and (3) second connector means for rotatably connecting said tool body to said first connector means while maintaining them in a connected end-to-end relationship; and (c) third, at least generally cylindrical connector means on said tool body for attaching the other element of the drill string and work means combination to said tool body, whereby said first and third connector means may be varied between a first configuration of axial alignment and a second configuration of axial misalignment by a third predetermined angle by rotating said first connection means with respect to said tool body between said first and said second locked positions.

16. The apparatus of claim 15 wherein said shaft is rotatably and slidably fitted in said bore, an extension of said third connector means away from said tool body to an extended position allowing it to freely rotate from said first position to said second position, and a retraction of said second connector means into proximity with said tool body being capable of producing a locking of said second connector means with said tool body, the rotation of said second connector means with said tool body thereby being impaired.

17. The apparatus of claim 16 wherein:

(a) said shaft is provided with a shoulder; and (b) said bore is likewise provided with a shoulder, whereby said second connector means is provided by the abutting contact of said shaft shoulder against said bore shoulder.

* * * * *